United States Patent [19]

Beck et al.

[11] Patent Number: 5,002,684

[45] Date of Patent: Mar. 26, 1991

[54] COMPOSITION AND METHOD FOR REMOVAL OF STAINS FROM FIBERS

[75] Inventors: Boyd R. Beck, Spring City, Utah; Robert D. Harris, Cameron Park, Calif.

[73] Assignee: Harris Research, Inc., Cameron Park, Calif.

[21] Appl. No.: 299,405

[22] Filed: Jan. 23, 1989

Related U.S. Application Data

[63] Continuation-in-part of Ser. No. 35,749, Apr. 8, 1987, abandoned.

[51] Int. Cl.[5] ..... C11D 3/09; B08B 3/04; D06L 3/10; D06L 3/16

[52] U.S. Cl. ..... 252/105; 8/137; 134/30; 252/173; 252/188.21; 252/550; 252/DIG. 19

[58] Field of Search ..... 252/105, 173, DIG. 19, 252/550, 188.21; 8/137; 134/30

[56] References Cited

U.S. PATENT DOCUMENTS

| | | | |
|---|---|---|---|
| 3,741,901 | 6/1973 | Ziffer | 252/89 |
| 3,919,101 | 11/1975 | Anstett et al. | 252/90 |
| 4,227,881 | 10/1980 | Fono | 8/102 |
| 4,268,406 | 5/1981 | O'Brien et al. | 252/105 |
| 4,552,692 | 11/1985 | Gillespie | 252/528 |
| 4,652,389 | 3/1987 | Moll | 252/90 |
| 4,678,595 | 7/1987 | Malik et al. | 252/174.17 |

FOREIGN PATENT DOCUMENTS

| | | | |
|---|---|---|---|
| 1209233 | 4/1963 | Fed. Rep. of Germany | 252/105 |
| 2640724 | 3/1978 | Fed. Rep. of Germany | 252/105 |

OTHER PUBLICATIONS

"Spotting", Judson C. Randlett & William J. Nicklaw, 1956 (National Inst. of Drycleaning, Inc., Silver Spring, Md.), pp. 73, 79, 83, 147–148 & 200–201.

*Primary Examiner*—Paul Lieberman
*Assistant Examiner*—A. Beadles-Hay
*Attorney, Agent, or Firm*—Thorpe, North & Western

[57] ABSTRACT

Solutions and method for the solubilizing and removal of dyes, synthetic red dyes in particular, are disclosed. The solutions consist of an aqueous mixture containing as essential ingredients (1) a detergent, preferably anionic, (2) a sulfite or bisulfite, (3) a lower alcohol and (4) ammonia or an amine. The combined ingredients cooperate to chemically alter the dye chromophore causing it to become soluble. The dye is removed by placing the solution on fibers stained with the dye for a time sufficient to allow the dye to be made soluble and the solution is then removed by either suction or absorption. Some dyes require treatment of the fiber with a solution followed by the application of moist heat through an absorbent material to assist in solubilizing and transferring the dye to the absorbent material. Particularly preferred are solutions consisting of 0.1–6% w. of a lauryl sulfate detergent salt, 5–15% w. of a sulfite or bisulfite, 20–40% w. of ethanol or methanol or a mixture thereof, and 2–10% w. of ammonia or a low alkyl or alkanol amine.

34 Claims, No Drawings

COMPOSITION AND METHOD FOR REMOVAL OF STAINS FROM FIBERS

This application is a continuation-in-part of application Ser. No. 035,749, filed Apr. 8, 1987, now abandoned.

BACKGROUND OF THE INVENTION

This invention relates to compositions and methods for removing stains from fabric fibers. More particularly, this invention relates to compositions and methods for the removal of permanent red food dye stains from fibers.

Many substances that come in contact with fabric fibers, such as carpets, leave what has been considered indelible or permanent discoloration on the fibers. One of the most persistent or permanent stains is that formed by FD&C Red #40. According to 21 CFR 74.340, this color additive is principally the disodium salt of 6-hydroxy-5-[(2-methoxy-5-methyl-4-sulfophenyl)azo]-2-naphthalene-sulfonic acid. This azo dye is approved for use in foods, drugs and cosmetics when used in amounts consistent with good manufacturing practices. For example, FD&C Red #40 is used in numerous unsweetened Kool-Aid brand drink mixes, e.g. apple, black cherry, cherry, grape, orange, pink lemonade, raspberry, strawberry and tropical punch, and, in sugar sweetened Kool-Aid brand drink mixes, e.g. apple, cherry, grape, pink lemonade, raspberry, strawberry and tropical punch. It is also present in numerous other beverages, foods, drugs and cosmetics from a variety of manufacturers. Also, there are other colorants or dyes, both synthetic and natural which indelibly stain fabric fibers. Natural reddish stains from raspberry, cranberry, boysenberry and cherry juices are but examples of various substances which can cause staining of fibers.

These stains are often difficult, if not impossible, to remove without changing the color of the original fabric material. In many instances, even if the stain is wholly or partially removed, the coloring used to dye the fabric initially is also affected and the area where the stain was appears different from the remainder of the fabric.

Most manufacturers of food products acknowledge that stains on carpeting caused by food coloring are very difficult to remove unless immediate action is taken. Generally, they advise blotting up as much of the staining material from the affected area as possible with an absorbent material such as a towel. The area spilled upon is then repeatedly sponged with clean cold water. If that is insufficient to remove all stain coloration, many household cleaning books or manufacturer's instructions suggest using diluted solutions of acetic acid (white vinegar) or citric acid (lemon juice) and water. Others suggest using a mixture of alcohol and water. Some also suggest that when the carpet or other fabric is dry, to sponge with a detergent and water solution. In many cases, these procedures are repeated many times to no avail. Other suggested methods, which are impractical for large items such as carpets, include pouring boiling water from a height of at least three feet above the fabric through the fabric to quickly remove fruit stains before they set. As a last resort, it is suggested that bleaching agents such as hydrogen peroxide combined with ammonia be applied to dampened fabric containing the stain. Even if such treatment is effective, it may only lighten the stain and not remove it. Such drastic treatment may also bleach original color from the fibers.

Even when following the above suggestions, dyes such as FD&C Red #40 may resist all treatment and, in many cases, the only way to remove stains is to remove or replace the carpet or other fabric. In fact, more carpets are replaced because of stains which cannot be removed than from carpets being worn out.

OBJECTS AND BRIEF SUMMARY OF THE INVENTION

It is an object of this invention to provide a composition and method for solubilizing and removing stains from fabric fibers.

It is also an object of this invention to provide a composition and method for removing stains caused by natural and synthetic food coloring from carpets and similar materials without affecting the colorants used to dye the fabrics initially.

An additional object of this invention is to provide compositions and methods for the rapid removal of food colors and similar stains from fabric fibers at the place where the staining occurred without having to remove the stained fabric to a central location.

These and other objects may be accomplished by applying to the stained fabric fibers an aqueous stain removal solution, as will be described, applying heated water vapor to the treated area to heat the stained fibers and solution to the point that the stain is chemically and/or physically solubilized and removing the solubilized stain and solution from the fibers by an absorbent material. In some instances, such as with natural fruit stains, it may not be necessary to apply heated water vapor or use an absorbent. It may only be necessary to allow the solution to remain on the fabric fibers long enough to allow an interaction between the stain chromophore and the solution wherein the chromophore becomes soluble. It can then be removed by conventional means using suction or an absorbent material.

In the preferred embodiment, stain removal is accomplished by applying the aqueous stain removal solution to the stained area of the carpet or other fabric, placing a damp towel or other absorbent material over the area, injecting steam through the absorbent material and into the stained fabric fibers through the sole plate of a steam iron or similar apparatus for a time sufficient to solubilize the stain and absorb the solution containing the solubilized stain onto the absorbent material. The steam or heated water vapor, and the temperature of the sole plate of the steam iron are not heated to the extent that the fibers of the fabric are damaged. Therefore, the steam iron, placed over the absorbent material, may remain in place for as long as necessary to solubilize the stain in the presence of the stain removal solution. The moisture supplied through the sole plate of the steam iron prevents the fabric from drying while the heat facilitates the stain solubilization. Once the stain is solubilized, it can be absorbed into the absorbent material. Depending upon the materials used in the stain removal solution, the stain, in becoming soluble, may also be chemically converted to a substance which is not a chromophore or to a lighter color entirely, i.e. from red to yellow.

The aqueous stain removal composition contains a combination of four essential ingredients, i.e. a detergent, a water soluble sulfite or bisulfite, a low molecular weight alcohol and ammonia or an amine. The detergent and sulfite or bisulfite can be present in amounts up to 50% by weight each provided there must be sufficient alcohol and ammonia or amine as explained below plus enough water present to bring about a suitable solution. The detergent serves to lower surface tension and, in some cases, is believed to form a soluble complex with the chromophore. The function of the bisulfite or sulfite ions is not known for a certainty. In certain instances, such as with FD&C Red #40, it is believed to act as an intermediate addition agent which temporarily adds an additional sulfonate group to the chromophore to render it more soluble. Because aqueous sulfite and bisulfite solutions tend to be oxidatively unstable, a low molecular weight alcohol is added to stabilize the solution and increase the dye removal rate. The presence of ammonia or an amine is also essential to increase the rate of the dye removal in the process. In some instances, the ammonia can be provided by utilizing an ammonium sulfite or bisulfite or an ammonium detergent salt. Amine salts can likewise be utilized.

As will now be discussed in detail, the invention comprises an aqueous stain removal solution and the methods of using it through the application of heated water vapor to solubilize the stain chromophore and facilitating the removal thereof via the means of an absorbent material.

DETAILED DESCRIPTION OF THE INVENTION

In its broadest form, the invention comprises the use of an aqueous stain removal solution consisting of, a detergent, a sulfite or bisulfite, a low molecular weight alcohol and ammonia or an amine and its application to food stained fabric fibers to solubilize the stain contained thereon. In its preferred method of use, the solution is placed on the fibers followed by the application of moist heat to solubilize the dye and transfer it on an absorbent material such as paper or cloth toweling. For some stains, the application of heat and absorbents are not necessary and the solubilized stain can be removed conventionally by suctioning or otherwise removing the solution from the fibers.

Suitable detergents for use in stain removal comprise all classes of detergents, i.e. anionic, cationic, non-ionic and amphoteric. All of these detergents function by lowering surface tension thus hastening the transfer of the dye to the absorbent material. Of these classes, the cationic and anionic detergents seem to work best and anionic detergents are particularly preferred.

Anionic detergents which can be used include straight and branched chain alkylaryl sulfonates wherein the alkyl group contains from about 8 to 15 carbon atoms; the lower aryl or hydrotropic sulfonates such as sodium dodecyl benzene sulfonate and sodium xylene sulfonate; the olefin sulfonates, such as those produced by sulfonating a $C_{10}$ to $C_{20}$ straight chained olefin; hydroxy $C_{10}$ to $C_{24}$ alkyl sulfonates; water soluble alkyl disulfonates containing from about 10 to 24 carbon atoms, the normal and secondary higher alkyl sulfates, particularly those having about 8 to 20 carbon atoms in the alkyl residue; sulfuric acid esters of polyhydric alcohols partially esterified with higher fatty acids; the various soaps or salts of fatty acids containing from 8 to 22 carbon atoms, such as the sodium, potassium, ammonium and lower alkanol-amine salts of fatty acids and sarcosinates of fatty acids.

Preferred anionic detergents are those having the formula:

$$R'AM'$$

wherein R' is $C_8$ to $C_{20}$ alkyl, aralkyl, or alkaryl; A is a sulfate ($SO_4$), sulfonate ($SO_3$), or sarcosinate ($CON(CH_3)CH_2COO$) radical; M' is a positive ion selected from the group consisting of sodium, potassium or $R''_4N$ wherein R'' is H, methyl, ethyl or hydroxyethyl. Typical alkyl groups include decyl, lauryl (dodecyl), myristyl (tetradecyl), palmityl (hexadecyl) and stearyl (octadecyl). Typical aralkyl groups include 2-phenylethyl, 4-phenylbutyl and up to 8-phenyloctyl and the various isomers thereof. Alkaryl groups include all ortho-, meta- and para- alkyl substituted phenyl groups such as p-hexylphenyl, 2,4,6-trimethylphenyl and up through p-dodecylphenyl. Specifically included are alkylbenzene sulfonates, alkyl sarcosinates and alkyl sulfates.

Particularly preferred are sodium, potassium, ammonium and lower or aryl amine salts of $C_8$ to $C_{20}$ alkyl sulfates. These sulfates are believed to form complexes with polysulfonated azo dyes which is surprising in view of published reports that only monosulfonated azo dyes interact with sodium lauryl sulfate as reported by Mitsuishi, Chem. Abstracts, Vol. 63, 1965, Col. 5809. According to Mitsuishi, only monosulfonated naphthalene azo dyes showed a shift in absorption maxima to longer wavelengths when these dyes are allowed to complex with sodium lauryl sulfate. The more hydrophilic dyes, i.e. disulfonated and trisulfonated, appeared to form no complex. However, alkyl sulfate salts were reported to act as electrolytes for other dyes causing an association of the dye. The most preferred detergents are the salts of lauryl sulfate, i.e. sodium lauryl sulfate, ammonium lauryl sulfate, potassium lauryl sulfate, and the mono-, di- and tri-ethanolamine salts of lauryl sulfate.

While detergent concentrations ranging from 0.1 and 50% by weight of the total composition are functional, it is preferred to use concentrations of between about 0.1 and 25% and most preferably between about 0.1 and 6% by weight.

The sulfites or bisulites useful in the invention have the formula:

$$M_xSO_3 \text{ or } M(HSO_3)_x$$

wherein x is an integer of 1 or 2 and M is a member selected from the group consisting of alkali metals, alkaline earth metals, or ammonium or substituted ammonium ions of the formula $R_4N$, wherein R is a member selected from the group consisting of H, $C_1$ to $C_5$ alkyl, $C_2$ to $C_3$ hydroxyalkyl, $C_7$ to $C_{12}$ aralkyl and $C_7$ to $C_{12}$ alkaryl and mixtures thereof. It is important that the sulfite or bisulfite is water soluble. Because of their solubility, alkali and ammonium sulfites and bisulfites are preferred. Ammonium sulfite and ammonium bisulfite are particularly preferred because of their solubility and also because they serve as a source of ammonia.

The concentration of the sulfite or bisulfite is primarily limited by its solubility. Concentrations should not exceed about 50% by weight of the total composition. Hence concentrations between 1 and 50% by weight are acceptable with concentrations of between about 5 and 15% being particularly preferred.

The exact mode by which the sulfite or bisulfite functions to impart solubility to the dye is not known for a certainty. In azo dyes, such as FD&C Red #40, having a 6-hydroxy naphthyl group, it is believed to produce an equilibrium mixture of a more soluble sulfite addition product as will be discussed. Because this addition intermediate is more soluble than the chromophore itself, it can be removed from the area surrounding the fiber more easily. The potassium, sodium and ammonium sulfites and bisulfites appear to work equally well in producing soluble intermediates. However, the ammonium salts are more effective in that they are believed to not only produce a more soluble intermediate, but also to produce more soluble yellow chromophore by replacing the 6-hydroxy group with a 6-amino group as will be explained.

Although both are functional, the sulfites are preferred over the bisulfites. It is believed that the bisulfite ion is converted to the sulfite ion in the presence of ammonia or an amine and that the sulfite forms an addition product with the chromophore more readily than the bisulfite. However, since both work well, and since a source of ammonia or amine is generally present, both are included in the invention.

It has been found that the presence of excess ammonia or a water soluble amine such as diethanol or triethanol amine also increases the rate of dye removal in the present invention. Although not wishing to be bound by any specific theory or mechanism, it is believed that the added ammonia or amine cooperatively functions with the sulfite or bisulfite in an addition-elimination mechanism as will be discussed in detail below. In other words, the amine assists in removing dyes such as FD&C Red #40 by converting it to a more soluble corresponding beta-naphthylamine or substituted beta-naphthylamine from the intermediate sulfite addition product. Preferably the ammonia or amine will have the formula $R_3N$ wherein R is as defined above for ammonium or substituted ammonium sulfite or bisulfites, i.e. R is a member selected from the group consisting of H, $C_1$ to $C_5$ alkyl, $C_2$ to $C_3$ hydroxyalkyl, $C_7$ to $C_{12}$ aralkyl and $C_7$ to $C_{12}$ alkaryl and mixtures thereof. Although many amines are effective in this reaction, ammonia is the most preferred due to its availability, and the availability of the corresponding ammonium salts of sulfite, bisulfite and detergent. When ammonium sulfite or bisulfites and/or ammonium detergent salts are used, it may not be necessary to add additional ammonia or amine if the ammonia concentration from these salts is sufficient. However, it has been found advantageous to include added ammonia as amines to the composition at rates of 1 to 20% with amounts of between about 2 and 10% by weight being preferred and concentrations of between about 2 and 5% by weight being especially preferred.

Because aqueous sulfite and bisulfite solutions tend to be oxidatively unstable, a low molecular weight $C_1$ to $C_5$ alcohol is preferably added to the aqueous stain removal compositions to stabilize the solution. These alcohols have also been found to increase the dye removal rate and to prevent bleaching that can possibly be produced by thermally initiated free radical reactions. Although methanol, ethanol, propanol and isopropanol, butanols and pentanols can be used, methanol and ethanol are preferred due to their availability, lower boiling points, ability to solubilize stains and inhibit undesirable bleaching side reactions. Ethanol is especially preferred due to its lower toxicity. However, practically speaking, denatured alcohols which are mixtures of ethanol and methanol will be most readily available. The concentration of alcohol can vary over a wide range from 1 to 80% by weight. Thus, when present, ranges of from about 1 to 80% are considered operable. Ranges of from about 5 to 50% are preferred with ranges of between about 20 to 40% by weight being particularly preferred.

Preferably, water will make up the remainder of the composition. However, any ingredients which do not interfere with the operation of the solution containing the combination of (a) the detergent, (b) the sulfite or bisulfite, (c) the ammonia or amine and (d) the alcohol, may be used without departing from the scope of the invention.

As previously stated, the stain removal solutions of this invention are functional in removing many natural and synthetic food color stains from fabrics. Again, it is to be emphasized that the exact mode by which these solutions function is not known with certainty. What is known is that they do solubilize and remove stains which have heretofore been difficult, if not impossible to remove.

The following is a depiction of one manner in which the present invention is thought to function in the removal of dye FD&C Red #40 by converting it to a more soluble form. The presence of detergent and alcohol are not noted in the reaction sequence. However, the detergent such as sodium or ammonium lauryl sulfate, lowers the surface tension, complexes with the dye and transfers it to an absorbent material. The alcohol functions in the manner described above. The sequence is:

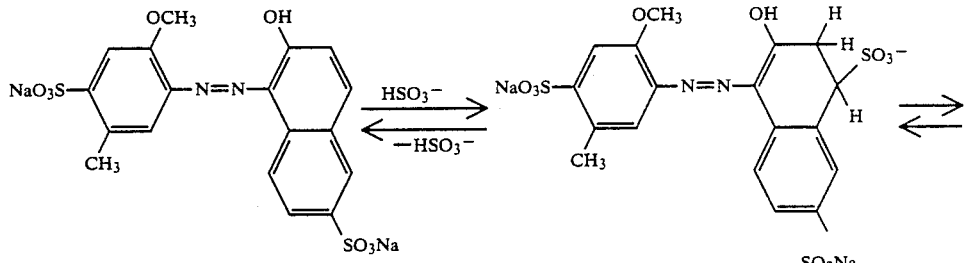

FD&C Red #40 | Sulfite or Bisulfite Addition | I | Sulfite Addition Enol Tautomer -continued

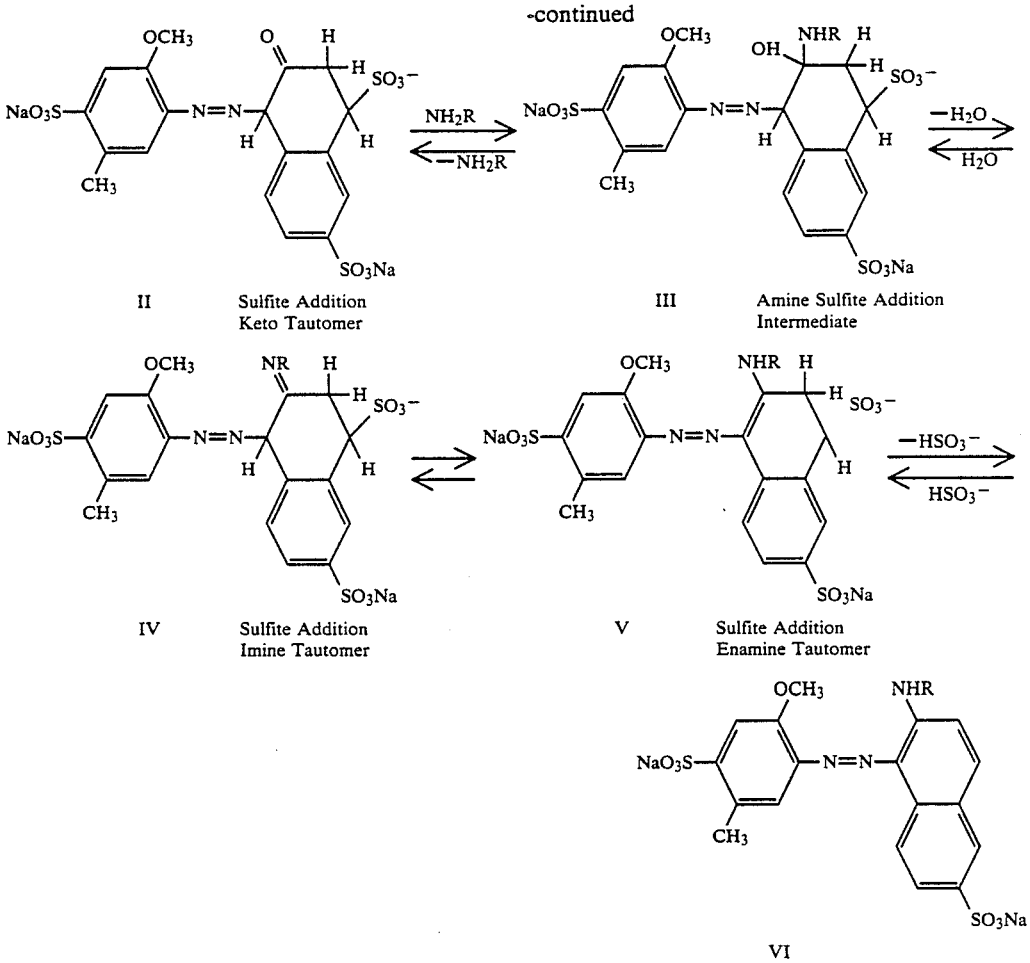

The above sequence is similar to that described as the Bucherer reaction for the conversion of naphthol compounds to naphthylamines. See Drake, Organic Reactions I, Wiley, N.Y., (1947) pp. 105–128. However, it is surprising that the reactions proceed under the presently noted reaction conditions. According to Drake, most reactions require the use of an autoclave at temperatures of between about 100°–150° C. for extended periods of time, e.g. eight to thirty-five hours. In the present invention, it has been found that the reaction proceeds in a matter of one to five minutes at temperatures of between about 80°–100° C. at ambient pressure. Of course, temperatures ranging from ambient up to higher temperatures of up to about 130° C. could be used provided there was no damage to the fabric fibers. Generally, the upper temperature will be controlled by the boiling point of the solution under the atmospheric pressure of the surroundings.

In the above reaction sequence, FD&C Red #40 i.e. the disodium salt of 6-hydroxy-5-[(2-methoxy-5-methyl-4-sulfophenyl)azo]-2-naphthalenesulfonic acid is treated with a bisulfite ion which adds across the 7 and 8 positions of the naphthalene ring to form either (I) a sulfite addition product shown in its enol tautomeric form, or (II) a sulfite addition product shown in its keto tautomeric form. In either event, the chromophore has had added to it an additional sulfonic acid group which renders it more soluble. When the reaction is carried out in the absence of an amine or ammonia, compound I or II may be transferred as an intermediate to an absorbent material in the presence of excess amounts of the sulfite or bisulfite anion which tends to prevent the reaction from being driven to the left. For compounds I or II which are not transferred to the absorbent material, the equilibrium favors the return of the chromophore back to the FD&C Red #40 form.

However, when ammonia or amine is present, the reaction continues to be driven to the right forming compound (III) which is an unstable intermediate amine-sulfite addition compound. The amine or ammonia is added at the 6 position competing with the hydroxyl group. The presence of the amine or ammonia drives the reaction to the right and, with the loss of water, a tautomer is formed. Compound IV is the sulfite addition imine tautomer and Compound V is the sulfite addition enamine tautomer. With the continued application of moist heat, the sulfite ion is released from intermediate Compounds IV or V thereby forming a more stable, and soluble, amino analog to the original chromophore, e.g. the disodium salt of 6-amino-5-[(2methoxy-5-methyl-4-sulfophenyl)azo]-2-naphthalenesulfonic acid which is yellow in color.

In the following procedures of this invention, the use of heated water vapors is generally, but not always, necessary to heat the reaction site and also provide mobile energy through the movement of the water particles bombarding the stain and other foreign matter of the fabric fibers and loosening and removing them for transfer to the absorbent material or other means. Some fruit stains may be sufficiently solubilized by treatment with the stain removal solution alone that the application of heat and steam and the use of an absorbent material are not necessary. In these instances, the stain removal composition is applied to the stain followed by removal by conventional means such as a wet and dry vacuum or by an absorbent material.

While not wishing to be bound by any particular theory, it is believed that many natural fruit dyes are acid dyes which are made soluble by either being converted to their salt form or by the addition or reducing agents such as sulfites and bisulfites. Many natural substances contain colored compounds that change color when subjected to a change in hydrogen ion concentration. These types of substances are often used as indicators in acid-base titrations. The presence of these chromophores in wine, grape, cranberry, raspberry, boysenberry, cherry and other natural juices are often the cause of stains of fabric fibers. While it is advantageous to change the color of these chromophores to a lighter color by converting them to their salt form by changing the hydrogen ion concentration, it is also necessary to remove these compounds from the fibers to provide a satisfactory stain removal process. Otherwise, the stain will reappear when the hydrogen ion concentration is raised.

One of the almost universal characteristics of these chromophores is that their basic salts are more soluble than their acidic forms. Also, these chromophores are believed to form sulfite or bisulfite addition products in much the same manner as disclosed above in the FD&C Red #40 reaction sequence. Once the more soluble form of the dye is produced, it can be removed by one or more of the following means.

Unlike some synthetic dyes, many natural dyes can be mobilized and absorbed from stained fibers without resorting to moist heat and absorption. Tests have shown that natural red colors from wine and fruit juices are changed almost immediately from red to a gray-green upon being treated with the stain removal solution disclosed herein. This conversion to the more soluble basic salt or to the sulfite or bisulfite addition form usually permits immediate removal by rinsing with water and vacuuming up the colored solution by appropriate suctioning means. This usually results in complete removal of the stain from the fibers.

However, in many instances the use of heated water vapor through an absorbent paper or cloth toweling will be necessary to solubilize and transfer the stain from the fabric fibers to the absorbent material. In most instances, the majority of the stain will be removed in a matter of seconds and seldom is a period of more than five minutes required. However, time is not a critical factor and, if necessary, heat and water vapor can be applied as long as necessary to interact with the stain removal solution allowing the stain to be rendered soluble and transferred to the absorbent material provided there is no damage to fabric fibers.

Any suitable absorbent material may be used. Paper towels are generally effective and can be disposed of. However, the use of cloth toweling or any other absorbent material is appropriate. It is only necessary that the absorbent material allow moist heated vapors to traverse through it and also be sufficiently absorbent that the solubilized stain can be transferred to it.

The following examples illustrate the best modes presently known for carrying out the invention.

EXAMPLE I

An aqueous stain removal solution was prepared by mixing 75.0 g. of ammonium lauryl sulfate (30% w. solution) with 125 g. of ethanol, 100 g. of ammonium bisulfite (45% w. solution), 37.6 g. of concentrated ammonia (28% w. solution) and 152.4 g. of water. The mixture formed a clear solution consisting of 4.6% w. detergent, 25.5% w. ethanol, 9.2% w. ammonium bisulfite 2.1% w. ammonia and 58.6% w. water.

A white nylon carpet was stained with a cherry beverage containing FD&C Red #40 dye and the dye was allowed to remain on the carpet fibers for a period of two weeks before removal treatment was attempted. The stain removal solution prepared above was used to saturate all red stained carpet fibers. Five paper towels were moistened with water, folded in half and placed on the carpet over the stain and solution. A steam iron filled with distilled water was set at a temperature between "delicate" and "permanent press" (which tested at 95° C.) and was placed over the towels and stain. After one minute, the stain was checked and was found to have changed from red to yellow. After two minutes, only a light yellow stain was visible. After three minutes, the stain was completely removed. No trace of red or yellow color remained and there was no visible evidence of damage to the carpet fibers. After 16 weeks, the fibers were again examined with no sign of the stain reappearing.

EXAMPLE II

The procedure of Example I was followed with the exception that 75 g. of water were used in the place of 75 g. of ammonium lauryl sulfate detergent.

The moist towels were treated with steam from the steam iron for a period of three minutes The stain was almost completely removed. Only a slight yellowing of the carpet was visible where the stain had been. This shows that the presence of detergent is preferable. Although the use of a solution containing bisulfite or sulfite, ethanol and ammonia without the detergent is functional to remove a majority of the stain, there was visible discoloration where the stain had been.

EXAMPLE III

The procedure of Example I was again followed with the exception that 125 g. of water were used in the place of 125 g. of ethanol.

The moist towels were treated with steam from the steam iron for a period of three minutes. As in Example II, the stain was almost completely removed. Again, a slight yellowing of the carpet was visible where the stain had been.

EXAMPLE IV

The procedure of Example I was followed with the exception that 100 g. of water were used in the place of 100 g. of ammonium bisulfite.

As in previous examples, the moist towels were treated with steam from the steam iron for a period of three minutes. The stain was considerably lightened but was not completely removed. The combined detergent, alcohol and ammonia solution was useful in removing a majority of the stain; however, a red spot was visible where the stain had been.

EXAMPLE V

The procedure of Example I was followed with the exception that 37.6 g. of water were used in the place of 37.6 g. of ammonia solution.

The moist towels were treated with steam from the steam iron for a period of three minutes as noted above. The stain was somewhat lighter due to the presence of both the detergent and bisulfite but was still visible.

EXAMPLE VI

Two compositions were prepared as in Example I with the exception that the ethanol was replaced with methanol and n-propanol respectively. The procedure of Example I was followed using these compositions. The methanol solution performed just as effectively as did the ethanol in Example I. With the n-propanol solution, there was some separation noted. However, when used for stain removal purposes, the solution containing n-propanol was visibly as effective in removing stains as was the ethanol used in the solution of Example I.

EXAMPLE VII

To compare the effects of various types of detergents on removal of FD&C Red #40, a series of solutions were prepared in accordance with Example I except that the detergent was different in each instance. The detergents used were as follows:

A. Ammonium lauryl sulfate (anionic)
B. Sodium lauryl sulfate (anionic)
C. Fluorochemical proprietary surfactant (Zonyl FSC DuPont) (cationic)
D. Fluorochemical proprietary surfactant (FC-135 3M Company) (cationic)
E. Fluorochemical proprietary surfactant (Zonyl FSA DuPont) (anionic)
F. Cetyl pyridinum bromide (cationic)
G. Hexadecyl pyridinum chloride (cationic)
H. Fluorochemical Surfactant (Zonyl FSB DuPont) (amphoteric)
I. Fluorochemical proprietary surfactant (FC-171 3M Company) (nonionic)
J. Fluorochemical Surfactant (Zonyl FSN DuPont) (nonionic)
K. Octyl phenoxypolyethyloxy ethanol (Triton X-100 Rohm & Haas) (nonionic)

As compared with the formulation of Example I using ammonium lauryl sulfate (ALS) the above compositions were judged to perform in alphabetical order from A through K.

EXAMPLE VIII

To further evaluate various detergents and compare them in their ability to complex with and remove FD&C Red #40 color on fibers, a 1% water solution of the following detergents A through U were prepared and compared on FD&C Red #40 dye removal following the procedure of Example I using a white terry cloth towel as the absorbent. The ability of the surfactant to remove dye was measured by the amount of dye transferred to the terry cloth toweling. Detergent A (ammonium lauryl sulfate) was the most effective. Following ammonium lauryl sulfate, the order from most to least dye transferred is listed in alphabetical order from A through U.

A. Ammonium lauryl sulfate (anionic)
B. Sodium lauryl sulfate (anionic)
C. Sodium lauryl sarcosinate (anionic)
D. Fluorochemical proprietary surfactant (FC-135 3M Company) (cationic)
E. Fluorochemical proprietary surfactant (Zonyl FSC DuPont) (cationic)
F. Fluorochemical proprietary surfactant (Zonyl FSA DuPont) (anionic)
G. Cetyl pyridinum bromide (cationic)
H. Hexadecyl pyridinum chloride (cationic)
I. Proprietary quaternary ammonium surfactant (Jordquat 1033 Jordan Chemical) (cationic)
J. Linear alkylate sulfonic acid (Bio Soft S-100 Stephan Chemical) (anionic)
K. 1:1 Coconut diethanolamide (Jordamide JT-128 Jordan Chemical) (nonionic)
L. Magnesium lauryl sulfate (anionic)
M. Coconut diethanolamide (Calamide C Pilot Chemical) (nonionic)
N. Fluorochemical Surfactant (Zonyl FSB DuPont) (amphoteric)
O. Coco amido betaine (Jordtaine CAB-35 Jordan Chemical) (amphoteric)
P. Lauryl dimethylamine oxide (Jordamox LDA Jordan Chemical) (nonionic)
Q. Fluorochemical Surfactant (Zonyl FSN DuPont) (nonionic)
R. Octyl phenoxypolyethyloxy ethanol (Triton X-100 Rohm & Haas) (nonionic)
S. Polyethylene glycol ether or primary alcohol (Tergitol 25-L-9 Union Carbide) (nonionic)
T. Polyethylene glycol ether or secondary alcohol (Tergitol 15-S20 Union Carbide) (nonionic)
U. Polyethylene glycol ether or secondary alcohol (Tergitol 15-S-9 Union Carbide) (nonionic)

EXAMPLE IX

Stain removal solutions were prepared and tested according to the procedure of Example I except the ammonia in the solution was replaced by the following amines:

J. Diethanol amine
K. Triethanol amine
L. Aniline
M. Glycine

All of the above amines turned FD&C Red #40 dye yellow except for M (glycine). The solution using L (aniline) is probably too toxic for practical use. However, solutions using J (diethanol amine) and K (triethanol amine) appeared to perform just as effectively as ammonia in removing the red dye.

EXAMPLE X

Two stain removal solutions were prepared without the presence of ammonia or an amine as part of the cation portion of either the detergent or sulfite or bisulfite. Also, no added ammonia or amine was present. These solutions were prepared according to the following:

Formulation N.
3.5 g. $Na_2SO_3$
5.0 g. ethanol
7.5 g. sodium lauryl sulfate (30% solution)
34.0 g. water Formulation O.
3.5 g. $NaHSO_3$
5.0 g. ethanol
7.5 g. sodium lauryl sulfate (30% solution)

The only difference between these formulations is that one contains the sulfite ion and the other the bisulfite ion.

When compared for ability to remove FD&C Red #40, neither performed as well as the solution of Example I and, due to the absence of ammonia or an amine, neither turned the chromophore yellow as in Example I or removed the stain as rapidly. However, N performed much better than O. Both removed most of the stain onto the absorbent.

EXAMPLE XI

The solution prepared in Example I was used to remove stains other than FD&C Red #40.

Port Wine: Port wine was poured on the white nylon carpet sample and allowed to remain until dry. The solution of Example I was placed on the stain which turned from purple to gray-green. This stain could be removed by means of a wet and dry vacuum without requiring treatment by means of steam and an absorbent material.

Fruit Juice: Grape, raspberry, cherry and cranberry juices were placed on a white nylon carpet sample and treated by the same procedure as with port wine. These natural stains were removed by suction without the addition of steam or the use of an absorbent material.

The above Examples illustrate the invention in its preferred embodiment. From the above, one skilled in the art can easily ascertain which detergents, sulfites or bisulfites, alcohols and ammonia or amines can be combined in an aqueous solution to interact with and solubilize stains. It is to be emphasized that the present invention does not function merely as a solvent in which stains are soluble. Moreover, the various ingredients do not merely perform an individual solvent function such that their combination into a single solution provides only the additive effects of each of their solvent properties. Each of the ingredients is essential in the interaction of the solution with the stain to chemically alter the stain chromophore so that it becomes soluble and can be removed in the manner provided for herein.

We claim:

1. A method for the removal of stains from fabric fibers comprising the steps of:

(a) applying to the stained fabric fibers an aqueous solution consisting essentially of (1) 0.1 to 50% w. of an anionic detergent, water soluble sulfite or bisulfite having the formula $$M_xSO_3 \text{ or } M(HSO_3)_x$$

wherein x is integer of 1 or 2 and M is a member selected from the group consisting of alkali metals, alkaline earth metals, or $R_4N$ wherein R is a member selected from the group consisting of hydrogen, $C_1$ to $C_5$ alkyl, $C_2$ to $C_3$ hydroxyalkyl, $C_7$ to $C_{12}$ aralkyl and $C_7$ to $C_{12}$ alkaryl and mixtures thereof; (3) 1 to 80% w. of a $C_1$ to $C_5$ alcohol; and (4) 1 to 20% w. of one or more compounds having the formula $R_3N$ wherein R is a member selected from the group consisting of hydrogen, $C_1$ to $C_5$ alkyl, $C_2$ to $C_3$ hydroxyalkyl, $C_7$ to $C_{12}$ aralkyl, $C_7$ to $C_{12}$ alkaryl and mixtures thereof;

(b) applying heated water vapor to said fabric fibers treated with said aqueous solution for a period of time sufficient to allow said stain on said fibers to interact with said solution and be rendered soluble; and (c) continuing the application of heated water vapor to said fibers and utilizing said water vapor as a means for transferring said solubilized stain from said heated fibers onto an absorbent material.

2. A method according to claim 1 wherein said anionic detergent contains at least one compound having the formula:

$$R'AM'$$

wherein R' is $C_8$ to $C_{20}$ alkyl, aralkyl, or alkaryl; A is a sulfate, sulfonate or sarcosinate radical and M is sodium, potassium or $R''_4N$ where R'' is H, methyl, ethyl or hydroxyethyl.

3. A method according to claim 2 wherein the sulfite or bisulfite is present in amounts ranging from between about 1–25% by weight.

4. A method according to claim 3 wherein the sulfite or bisulfite is a member selected from the group consisting of ammonium sulfite, sodium sulfite, potassium sulfite, ammonium bisulfite, sodium bisulfite and potassium bisulfite.

5. A method according to claim 4 wherein the detergent is present in amounts ranging from about 0.1 to 25% w.

6. A method according to claim 5 wherein the $C_1$ to $C_5$ alcohol is present in amounts ranging from 5 to 50% w.

7. A method according to claim 6 wherein the alcohol is methanol or ethanol or mixtures thereof.

8. A method according to claim 7 wherein the solution contains from about 2 to 10% w. of one or more compounds of the formula $R_3N$ wherein R is a member selected from the group consisting of H, methyl, ethyl, propyl, hydroxymethyl or hydroxyethyl.

9. A method according to claim 8 wherein the detergent is present in amounts of between about 0.1 and 6% by weight; the sulfite or bisulfite is present in amounts of between about 5 and 15% by weight; the alcohol is present in amounts of between about 20 and 40% by weight and the compound of the formula $R_3N$ is present in amounts of between about 2 and 5% by weight.

10. A method according to claim 9 wherein in the detergent R' is alkyl and A is a sulfate radical.

11. A method according to claim 10 wherein the detergent is a member selected from the group consisting of ammonium lauryl sulfate, sodium lauryl sulfate and potassium lauryl sulfate.

12. A method according to claim 11 wherein the detergent is sodium lauryl sulfate, the bisulfite or sulfite is ammonium sulfite and $R_3N$ is ammonia.

13. A method according to claim 11 wherein the detergent is ammonium lauryl sulfate, the bisulfite or sulfite is ammonium sulfite and $R_3N$ is ammonia.

14. A method according to claim 11 wherein the detergent is potassium lauryl sulfate, the bisulfite or sulfite is ammonium sulfite and $R_3N$ is ammonia.

15. A method according to claim 11 wherein the detergent is sodium lauryl sulfate, the bisulfite or sulfite is ammonium bisulfite and $R_3N$ is ammonia.

16. A method according to claim 11 wherein the detergent is ammonium lauryl sulfate, the bisulfite or sulfite is ammonium sulfite and $R_3N$ is ammonia.

17. A method according to claim 11 wherein the detergent is potassium lauryl sulfate, the bisulfite or sulfite is ammonium bisulfite and $R_3N$ is ammonia.

18. An aqueous composition for the removal of stains from fabric fibers consisting essentially of:

(a) about 0.1 to 50% w. of an anionic detergent;

(b) 1 to 50% w. of a water soluble sulfite or bisulfite having the formula:

$M_xSO_3$ or $M(HSO_3)_x$ wherein x is integer of 1 or 2 and M is a member selected from the group consisting of alkali metals, alkaline earth metals, or $R_4N$ wherein R is a member selected from the group consisting of hydrogen, $C_1$ to $C_5$ alkyl, $C_2$ to $C_3$ hydroxyalkyl, $C_7$ to $C_{12}$ aralkyl and $C_7$ to $C_{12}$ alkaryl and mixtures thereof;

(c) 1 to 80% w. of a $C_1$ to $C_5$ alcohol; and (d) 1 to 20% w. of one or more compounds having the formula $R_3N$ wherein R is a member selected from the group consisting of hydrogen, $C_1$ to $C_5$ alkyl, $C_2$ to $C_3$ hydroxyalkyl, $C_7$ to $C_{12}$ aralkyl, $C_7$ to $C_{12}$ alkaryl and mixtures thereof.

19. A composition according to claim 19 wherein said anionic detergent contains at least one compound having the formula:

R'AM' wherein R' is $C_8$ to $C_{20}$ alkyl, aralkyl, or alkaryl; A is a sulfate, sulfonate or sarcosinate radical and M' is sodium, potassium or $R''_4N$ wherein R'' is H, methyl, ethyl or hydroxyethyl.

20. A composition according to claim 19 wherein the sulfite or bisulfite is present in amounts ranging from between about 1–25% by weight.

21. A composition according to claim 20 wherein the sulfite or bisulfite is a member selected from the group consisting of ammonium sulfite, sodium sulfite, potassium sulfite, ammonium bisulfite, sodium bisulfite and potassium bisulfite.

22. A composition according to claim 21 wherein the detergent is present in amounts ranging from about 0.1 to 25% w.

23. A composition according to claim 22 wherein the $C_1$ to $C_5$ alcohol is present in amounts ranging from 5 to 50% w.

24. A composition according to claim 23 wherein the alcohol is methanol or ethanol or mixtures thereof.

25. A composition according to claim 24 wherein the solution contains from about 2 to 10% w. of one or more compounds of the formula $R_3N$ wherein R is a member selected from the group consisting of H, methyl, ethyl, propyl, hydroxymethyl or hydroxyethyl.

26. A composition according to claim 25 wherein the detergent is present in amounts of between about 0.1 and 6% by weight; the sulfite or bisulfite is present in amounts of between about 5 and 15% by weight; the alcohol is present in amounts of between about 20 and 40% by weight and the compound of the formula $R_3N$ is present in amounts of between about 2 and 5% by weight.

27. A composition according to claim 26 wherein the detergent R' is alkyl and A is a sulfate radical.

28. A composition according to claim 27 wherein the detergent is a member selected from the group consisting of ammonium lauryl sulfate, sodium lauryl sulfate and potassium lauryl sulfate.

29. A composition according to claim 28 wherein the detergent is sodium lauryl sulfate, the bisulfite or sulfite is ammonium sulfite and $R_3N$ is ammonia.

30. A composition according to claim 28 wherein the detergent is ammonium lauryl sulfate, the bisulfite or sulfite is ammonium sulfite and $R_3N$ is ammonia.

31. A composition according to claim 28 wherein the detergent is potassium lauryl sulfate, the bisulfite or sulfite is ammonium sulfite and $R_3N$ is ammonia.

32. A composition according to claim 28 wherein the detergent is sodium lauryl sulfate, the bisulfite or sulfite is ammonium bisulfite and $R_3N$ is ammonia.

33. A composition according to claim 28 wherein the detergent is ammonium lauryl sulfate, the bisulfite or sulfite is ammonium bisulfite and $R_3N$ is ammonia.

34. A composition according to claim 28 wherein the detergent is potassium lauryl sulfate, the bisulfite or sulfite is ammonium bisulfite and $R_3N$ is ammonia.

* * * * *